US008201528B2

(12) United States Patent
Knecht et al.

(10) Patent No.: US 8,201,528 B2
(45) Date of Patent: Jun. 19, 2012

(54) DOUBLED CAM SHAFT ADJUSTER IN LAYERED CONSTRUCTION

(75) Inventors: Andreas Knecht, Kusterdingen (DE); Dirk Pohl, Kirchentellinsfurt (DE)

(73) Assignee: Hilite Germany GmbH, Marktheidenfeld (DE)

( * ) Notice: Subject to any disclaimer, the term of this patent is extended or adjusted under 35 U.S.C. 154(b) by 724 days.

(21) Appl. No.: 12/319,226

(22) Filed: Jan. 2, 2009

(65) Prior Publication Data

US 2009/0183702 A1 Jul. 23, 2009

Related U.S. Application Data

(60) Provisional application No. 61/010,179, filed on Jan. 4, 2008.

(51) Int. Cl.
*F01L 1/34* (2006.01)

(52) U.S. Cl. ..... 123/90.17

(58) Field of Classification Search ..... 123/90.17, 123/90.15; 464/160, 161
See application file for complete search history.

(56) References Cited

U.S. PATENT DOCUMENTS

| | | | | |
|---|---|---|---|---|
| 2,911,956 | A | 11/1959 | Smith, Jr. | |
| 4,332,222 | A | 6/1982 | Papez | |
| 5,233,948 | A | 8/1993 | Boggs et al. | |
| 5,235,939 | A | 8/1993 | Levin et al. | |
| 6,076,492 | A | 6/2000 | Takahashi | |
| 6,253,719 | B1 | 7/2001 | Methley | |
| 6,510,827 | B2 | 1/2003 | Schreeck et al. | |
| 6,546,842 | B2 | 4/2003 | Raikamo | |
| 6,725,817 | B2 * | 4/2004 | Methley et al. | 123/90.17 |
| 6,814,036 | B2 | 11/2004 | Palesch et al. | |
| 6,832,583 | B2 | 12/2004 | Hayman | |
| 6,945,205 | B2 | 9/2005 | Heintzen et al. | |
| 7,004,130 | B2 | 2/2006 | Bolz et al. | |
| 7,270,096 | B2 | 9/2007 | Lancefield et al. | |
| 7,284,517 | B2 * | 10/2007 | Lancefield et al. | 123/90.17 |
| 7,287,499 | B2 | 10/2007 | Lawrence et al. | |
| 7,503,293 | B2 * | 3/2009 | Lettmann et al. | 123/90.15 |
| 7,610,890 | B2 | 11/2009 | Lettmann et al. | |
| 7,841,311 | B2 * | 11/2010 | Hutcheson et al. | 123/90.17 |
| 2002/0059910 | A1 | 5/2002 | Methley et al. | |
| 2002/0096044 | A1 | 7/2002 | Raikamo | |
| 2002/0104497 | A1 | 8/2002 | Schreeck et al. | |
| 2003/0177991 | A1 | 9/2003 | Palesch et al. | |
| 2004/0226524 | A1 | 11/2004 | Hayman | |
| 2005/0109298 | A1 | 5/2005 | Bolz et al. | |
| 2006/0185471 | A1 | 8/2006 | Lawrence et al. | |
| 2007/0034182 | A1 | 2/2007 | Dengler | |
| 2007/0039411 | A1 | 2/2007 | Lechner et al. | |
| 2007/0240657 | A1 | 10/2007 | Schneider | |
| 2008/0257290 | A1 | 10/2008 | Lettmann et al. | |
| 2009/0223470 | A1 * | 9/2009 | Rozario et al. | 123/90.17 |

FOREIGN PATENT DOCUMENTS

| | | |
|---|---|---|
| DE | 36 24 827 | 2/1988 |
| DE | 43 32 868 | 3/1995 |
| DE | 199 14 909 | 10/2000 |
| DE | 101 02 767 | 7/2002 |
| DE | 10 2004 023 451 | 12/2004 |

(Continued)

*Primary Examiner* — Thomas Denion
*Assistant Examiner* — Daniel Bernstein
(74) *Attorney, Agent, or Firm* — Lipsitz & McAllister, LLC

(57) ABSTRACT

The present invention provides a cam shaft adjuster, which is designed for controlling a double cam shaft, which has a layered construction. The cam shaft adjuster is equipped with a first rotor-type output body and a second rotor-type output body which are arranged parallel to each other with their rotary vane body parts.

22 Claims, 7 Drawing Sheets

FOREIGN PATENT DOCUMENTS

| | | |
|---|---|---|
| DE | 102004024222 | 3/2005 |
| DE | 103 46 446 | 5/2005 |
| DE | 103 46 448 | 6/2005 |
| DE | 10 2005 014 680 | 8/2006 |
| EP | 0 397 540 | 11/1990 |
| EP | 1 234 954 | 8/2002 |
| EP | 1 347 154 | 9/2003 |
| EP | 1 696 107 | 8/2006 |
| JP | 11-173120 | 6/1999 |
| WO | 92/12333 | 7/1992 |
| WO | 01/12996 | 2/2001 |
| WO | 2005/040562 | 5/2005 |

* cited by examiner

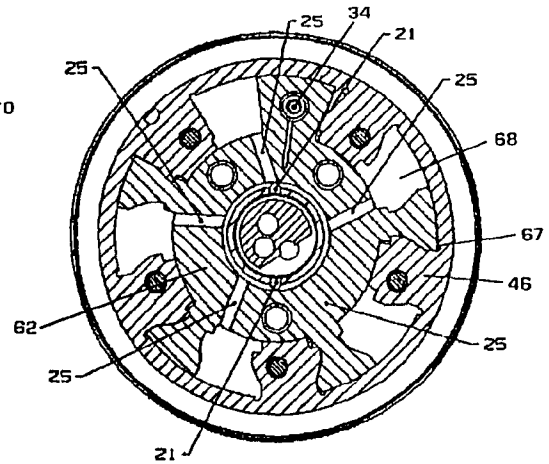
Fig. 4 C-C
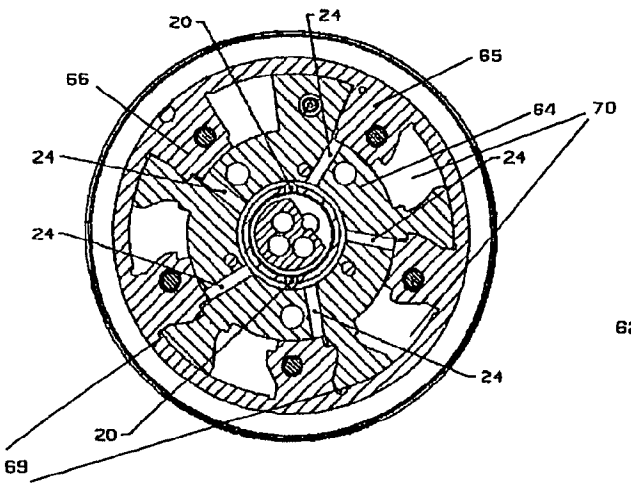
Fig. 3 B-B
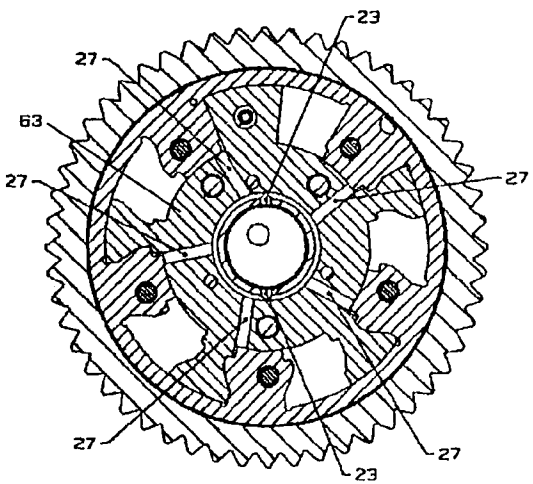
Fig. 6 E-E
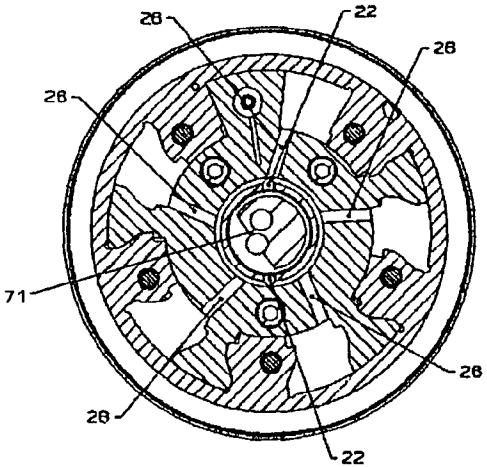
Fig. 5 D-D

F - F

DOUBLED CAM SHAFT ADJUSTER IN LAYERED CONSTRUCTION

This application claims the benefit of U.S. Provisional Patent Application No. 61/010,179, filed Jan. 4, 2008, which is incorporated herein and made a part hereof by reference.

The present invention relates to a valve drive of an internal combustion engine with a doubled cam shaft.

BACKGROUND OF THE INVENTION

EP 1 347 154 A2 discloses a rotary drive designed for an adjustment shaft of a variable valve drive. A first rotatory, hydraulic drive is connected to a second rotatory, hydraulic drive in such a way as to allow rough and fine adjustment of the exact eccentric position within a valve drive chain. In other words, the angle of rotation position to be set is facilitated by a two-stage system.

U.S. Pat. No. 2,911,956 describes a plate-shaped positioner by means of which a pivoting movement of a first plate influences the pivoting range of a second plate and so on.

WO 01/12996 A1 shows in FIG. 5*a* a two-stator shaft adjustment system in which the rotor is restricted in its pivoting range by the rotation of a first and second stator.

U.S. Pat. No. 5,233,948 discloses what advantages can be obtained if the cams of superimposed cam shafts are adjustable relative to one another. It is possible to infer from this disclosure the desire to create valve drives which are configured in such a way that they can individually control results of a plurality of gas exchange valves of a combustion chamber. Although this reference discloses the theoretical advantages, there are no proposals for a specific implementation. The basic principles which are theoretically disclosed in this reference are deemed to be incorporated herein by reference.

Approaches for carrying out the teaching of U.S. Pat. No. 5,233,948 are known from FIGS. 4A to 4C of U.S. Pat. No. 5,235,939 which illustrates a coaxial double cam shaft with at least two sets of cams which are angularly offset relative to one another and the cams of which are fastened to the respective carrying cam shaft by fastening pins and fastening springs. A similar arrangement is known from WO 2005/040562 A1. According to the description, the cam position is to be adjusted using hydraulic linear cylinders. A similar design is known from FIG. 1 of DE 43 32 868 A1, which is likewise intended to adjust, by way of a linear movement, the cam position of an inlet cam relative to an outlet cam. The account in EP 0 397 540 A1 also shows a linear-adjustable cam shaft arrangement. FIGS. 5 and 6 of U.S. Pat. No. 4,332,222 disclose a contoured feed pin which influences via its surface the angular distance between two cams and thus the relative position of the connected cam shafts. According to DE 36 24 827 A1, two meshing hollow shaft cam shafts can be adjusted relative to each other in their angular position via a planetary gear with longitudinal holes. However, in order to comply with current exhaust gas values in high-compression combustion engines, the outer shaft must also be adjustable relative to the driving shaft, in particular the crank shaft. DE 199 14 909 A1 discloses further grounds for creating a nested cam contour. The cam contour of the main cam of a cam shaft can be extended by an auxiliary cam in order to activate the associated gas exchange valve a second time, in a time-offset manner relative to the main event, and thus to allow reloading of, or a further outflow from, the cylinder. Finally, reference should also be made to the two documents JP 11 17 31 20 and WO 1992/012 333, which may also be relevant as background information.

In summary, it is clear that it has for years been a recurring consideration how events which are to be offset from one another over time can be made adjustable in their phase positions in the gas exchange valve drive.

DE 10 2005 014 680 A1 shows in certain graphical illustrations a double cam shaft which is equipped with a connected, grooved oil transfer piece, thus allowing the hydraulic oil to be forwarded to a hydraulic adjuster (not shown).

A cam shaft adjuster for the relative rotation of a hollow cam shaft and a second chain wheel arranged parallel to the first chain wheel is described in U.S. Pat. No. 6,253,719. Instead of arranging next to each other the two chain wheel adjusters which are constructed in a disc-type manner, U.S. Pat. No. 6,725,817 B2 show various embodiments of a mutually nested adjuster which lies in the same plane and the first adjustment element of which can rotate a first set of cams of the concentric cam shaft, while the second adjustment element is designed to rotate a second set of cams of the concentric cam shaft. Thus, the angular rotation of one set of cams influences the accessible angular range of the other set of cams. It would be more beneficial if the sets of cams of the double cam shafts could be adjusted, as independently of one another as possible, in a further, larger adjustment range compared thereto.

The statement of object of U.S. Pat. No. 6,076,492 states that it is a problem, even in the case of simply constructed cam shaft adjusters of an axially displaceable type, to orient the cam shaft adjuster, the cylinder head, the control valve and the cam shaft in a stationary, permanent manner. Even in the case of such sufficiently known cam shaft adjusters, there is a risk of the individual components tilting relative to one another.

The described embodiments of two gas exchange valve actuating means which can be offset or adjusted relative to each other on a control shaft are included merely by way of the references thereto in the scope of the description of the present invention in order in this way to increase the readability of the description of the invention and thus to be able to emphasize more clearly the progressive aspects of the present invention.

A gas exchange valve control shaft, which is constructed from two mutually engaging, preferably coaxially arranged cam shafts surrounding the inner cam shaft, is also occasionally referred to herein as a double cam shaft. A double cam shaft is a cam shaft of dual construction. Experts frequently associate with the term "cam shaft" a single shaft on which all cams are arranged stationarily relative to one another.

OBJECT OF THE INVENTION

The aim of the present invention is to provide important parts of a valve drive for internal combustion engines, which valve drive has a cam shaft, such as a gas exchange valve control shaft, with two cams which can be adjusted relative to each other and are located in particular in immediate proximity. This necessitates the design of a suitable cam shaft adjuster which can adjust both the cams relative to a driving shaft and the cams of one type relative to the cams of the other type in as angularly correct a manner as possible under particular operating conditions, the cams being fastened to a corresponding cam shaft. All references in this connection to cams in the plural also include any embodiment in which there is only a single cam of a specific type on a cam shaft. Ideally, the principle of the valve drive may be applied to all previously disclosed applications (offsetting over time of the inlet relative to the outlet gas exchange valves, adjustment in space and/or over time between two similar gas exchange valves of a combustion chamber, the creating of a subsequent opening event, the creating of preceding opening events) of mutually nested cam shafts.

SUMMARY OF THE INVENTION

The technical problems noted above are solved by the present invention, which provides a doubled cam shaft adjuster with a layered construction.

A rotor, which is arranged in a specific angular range so as to be able to move back and forth between webs of a stator which can also be configured as part of the surrounding housing, may also be referred to as a rotary vane. The term "rotary vane" refers more to the vane-type appearance of the central, middle, pivotably movable cam shaft linking member, which is frequently referred to as the output body, while the term "rotor" refers more to the rotating property of the output body relative to otherwise conventional axially linear adjustment elements.

The cam shaft adjuster is part of a variable valve drive of an internal combustion engine. The internal combustion engine has at least one gas exchange valve control shaft. The gas exchange valve control shaft has two concentrically arranged cam shafts which are rotationally adjustable relative to each other, so that at least two cams are angularly rotatable relative to one another. A cam shaft adjuster is thus composed of two partial cam shaft adjusters. Each partial cam shaft adjuster can per se, independently of the other partial cam shaft adjuster, sweep the full angular range independently of the position of the other cam shaft adjuster. Each partial cam shaft adjuster relates its relative position to the same external central drive shaft, such as for example the crank shaft. A partial cam shaft adjuster of the cam shaft adjuster operates in accordance with a rotary vane principle and thus allows relative rotation between a drive body and at least one output body. The cam shaft adjuster has two rotary vane adjusters, each of which is associated with a cam shaft, the two rotary vane adjusters being arranged one after the other axially in the shaft direction. The cam shaft adjusters are constructed with their respective cam shafts in a mechanically secure connection.

The cam shaft adjuster, which is designed for controlling a double cam shaft, follows a layered construction. The cam shaft adjuster is equipped with a first rotor-type output body and a second rotor-type output body which are arranged parallel to each other with their rotary vane body parts. Each of the at least two output bodies has a receptacle which is designed for the reception, leading laterally out of the cam shaft adjuster center, of at least one cam shaft of the double cam shaft. A compensating element is provided for axially orienting at least one output body relative to the double cam shaft. The compensating element is an element which avoids jamming and deflection.

According to a further aspect, a difficulty consists in the fact that coaxially arranged components which can tilt relative to one another, such as for example the first rotor, the second rotor, the first cam shaft and the second cam shaft, are exposed to thermal loads and vibrations, so that the components can become jammed relative to one another and relative to the components which are stationary relative thereto, such as a chain wheel. The jamming takes place partly as a result of lateral tilting or an imbalance which causes deflection from the normal line onto a right angle between an individual rotor and a cam shaft. A compensating element, which can for example be a cross joint, can be used to configure the orientation of the outer rotor (e.g., the first rotor) toward the inner cam shaft with orientable play. Advantageously, the compensating element is mounted upstream of a central cam shaft fastening screw which is screwed into the inner cam shaft. The compensating element is located in the axial extension of the doubled cam shaft. The cross-type compensating element as two planes, of which one is intended for engagement with the inner cam shaft and the other plane for engagement with the outer rotor mounted upstream. The non-engaging transverse web region of the cross element has sufficient spacing or play from the surrounding component, i.e. either a rotor or a cam shaft, while the engaging transverse web region rests against its adjacent component in a form-fitting manner. The compensating elements are expediently rotary sliding members or rotary sliding elements. Alternatively, rotary journals may also be employed.

The compensating element is a movable member which creates at least one degree of freedom and allows deflection, in particular differing from a right angle, of the surrounding output body relative to the double cam shaft to be connected, in particular relative to the inner part of the cam shaft. The right angle is sought in relation to the direction of arrangement between the extension of the cam shaft adjuster and the double cam shaft. A right angle, i.e. a 90° angle, is present at the point of transition between the (double) cam shaft adjuster and double cam shaft without deflection of the components relative to one another.

According to one configuration, the compensating element of the cam shaft adjuster is a cross joint. One of the rotary journals of the cross joint can be brought into abutment with the cam shaft. The other journal can be brought, on angling in the opposite direction, into contact with the output member. The cross joint is advantageously selected if particular mechanical stability of the compensating element is required.

According to a further configuration, the compensating element can be a fitting key for a corresponding groove which is in particular embodied in a dually spherical manner. The fitting key allows lateral tilting-out of the output body in a cam shaft axial direction. The cam shaft axial direction is the direction in which the cam shaft extends. The fitting key takes up very little space. A fitting key is a part which is easy to install and to mount.

A particularly large amount of material may be saved if the cam shaft adjuster has just a single axial compensating element. The compensating element provides compensation. The compensation is in the radial, angular and axial direction, i.e. 5 of the 6 degrees of freedom are attained as a result of a configuration of the compensating element. Alternatively, compensating elements of the type having fewer degrees of freedom, for example only 1 degree of freedom, or else 2 or 3 degrees of freedom, are also beneficial. According to an advantageous configuration, the compensating element can be arranged at the side remote from the cam shaft. The cam shaft adjuster can be composed of two parallel individual adjusters. Two rotary vane adjusters are constructed parallel next to each other. Each rotary vane adjuster is uncoupled from the other. They lie uncoupled from each other at an angle of rotation, delimited by two respective webs of a single drive body. The drive body is simply continuous. A single drive body is present. The drive body is regarded as a continuous component. The drive body can also be configured in one piece.

The present invention also provides a variable valve drive of an internal combustion engine. In one example embodiment, the variable valve drive is part of an internal combustion engine with a gas exchange valve control shaft. The gas exchange valve control shaft has a double cam shaft with concentrically arranged cam shafts. The individual cam shafts are rotationally adjustable relative to one another. The adjustment of the cam shafts relative to one another allows at least two cams to be to be angularly rotated relative to one another. The cam shaft adjuster described hereinbefore operates in accordance with the rotary vane principle. The rotary vane principle allows relative rotation between a drive body and at least one output body. An axial compensating element is provided for axially orienting and joining the cam shaft adjuster relative to the gas exchange valve control shaft issuing laterally therefrom. The compensating element has the function of a joint. The compensating element is arranged on the side of the cam shaft adjuster that is remote from the cam shaft. As a result, the compensating element is located at the point of greatest deflection in the event of tilting.

In the variable valve drive, each rotary vane adjuster, a combination of rotor and stator which operates in accordance with the swivel motor principle, is part of a hydraulic swivel motor. The swivel motor operates by carrying out an angular adjustment by way of a hydraulic pressure in two sets of opposing hydraulic chambers. The swivel motor is configured in a rotor-type manner. Each swivel motor is a respective output body of a cam shaft. Each output body comprises a vane crown connected to a rotor core. The vane crown can be moved back and forth between web stops of a surrounding stator housing. The advantages of swivel motor-type cam shaft adjusters are known to those skilled in the art. The advantages of the swivel motor can, according to one aspect of the present invention, be utilized twice.

The gas exchange valve control shaft of the valve drive is a coaxial dual cam shaft. In the case of the gas exchange valve control shaft, a first cam shaft is configured as a hollow body in such a way that a second cam shaft runs in the first cam shaft. The first cam shaft displays at least one recess through which a cam of the second cam shaft protrudes onto the outside of the dual cam shaft. Two cam shafts can now in a space-saving manner be placed running parallel at the location where otherwise only one cam shaft is to be arranged.

The valve drive may have only one drive wheel. The drive wheel may be configured as follows. The cam shaft adjuster has the one drive wheel. The drive wheel can for example be a chain wheel driven by the crank shaft. The valve drive thus has overall only one drive wheel driven by the crank shaft. The drive wheel is according to one configuration arranged on the side that is close to the cam shaft in such a way that a rotatable connection crown runs in synchronisation with the drive wheel for taking over and forwarding the hydraulic fluid to each chamber of the first and the second rotary vane adjuster. Only one connection crown is therefore provided, in order to minimise the number of components.

Two feed line channels, which are arranged closer to the cam shaft axis, lead from the connection crown into the rotary vane adjuster which is arranged further apart from the introduction points of the connection crown. Two feed line channels, which are arranged further apart from the cam shaft axis, lead into the rotary vane adjuster which is close to the connection crown. The channels can therefore be arranged parallel to the cam shaft adjuster axis over a significant stretch. The oil flows freely into the respective chamber to be activated.

According to a further exemplary embodiment, the oil conveying channels can also be fed from an face of the cam shaft adjuster to the respective chambers of the different types (advance chamber and retard chamber) using an oil distributor. At least four channels are provided for this purpose. In one example embodiment, each channel has a length differing from the other channels. The channels open into the end-side chamber feed lines which can be configured in a planar manner. The conveyance of oil is likewise easy to establish and very reliable.

The output body which may be remote from the gas exchange valve control shaft is designed for adjusting an inner cam shaft. The output body, which may be arranged closer toward the gas exchange valve control shaft, is designed for adjusting an outer cam shaft surrounding the inner cam shaft. The determination takes place by way of secure, permanent fixing, such as for example screwing, shrinking-on or welding. According to one configuration, the remote output body can therefore be screwed at the face onto the inner cam shaft. The output body facing the cam shaft can be shrunk onto the outer cam shaft.

The connection crown has at least four hydraulic ports. The connection crown is the point for transfer of the hydraulic medium between a stationary arrangement and a moving part, namely the valve drive control shaft. In order to forward from a stationary bearing ring, which is configured in particular as part of the cylinder head of an internal combustion engine, individually adjustable hydraulic fluids in hydraulic chambers of each rotary vane adjuster, the ports, at least four ports, are formed in the connection crown.

In order to set the gas exchange valve control shaft to a preferred position or situation, or to ensure that a constrained position is assumed under particular operating states such as start, stop or failure, a spring is inserted into the drive wheel. The drive wheel can be pressed by the spring into a specific position. The spring is in a flat configuration and may be, for example, a spiral spring. The spring is supported at one side on the drive wheel in order to press at least one of the two rotary vane adjusters into a constrained position.

Because all that matters for true running of the internal combustion engine is that the absolute settings of the angular relationship of the individual cam shafts to the driving shaft remains, in accordance with an adjustment process, within a maximum selected oscillation bandwidth, compensating elements as simple as a cross joint or a longitudinally movable fitting key can be used for directional orientation between the output member and cam shaft. Jamming is reliably suppressed as a result of the angular movability of the outer part of the cam shaft adjuster, the outer output member.

BRIEF DESCRIPTION OF THE DRAWINGS

The present invention will hereinafter be described in conjunction with the appended drawing figures, wherein like reference numerals denote like elements, and:

FIG. 3 shows the cam shaft adjuster according to FIG. 1 along the section B-B in FIG. 2;

FIG. 4 shows the cam shaft adjuster according to FIG. 1 along the section C-C in FIG. 2;

FIG. 5 shows the cam shaft adjuster according to FIG. 1 along the section D-D in FIG. 2;

FIG. 6 shows the cam shaft adjuster according to FIG. 1 along the section E-E in FIG. 2;

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Figure 1:
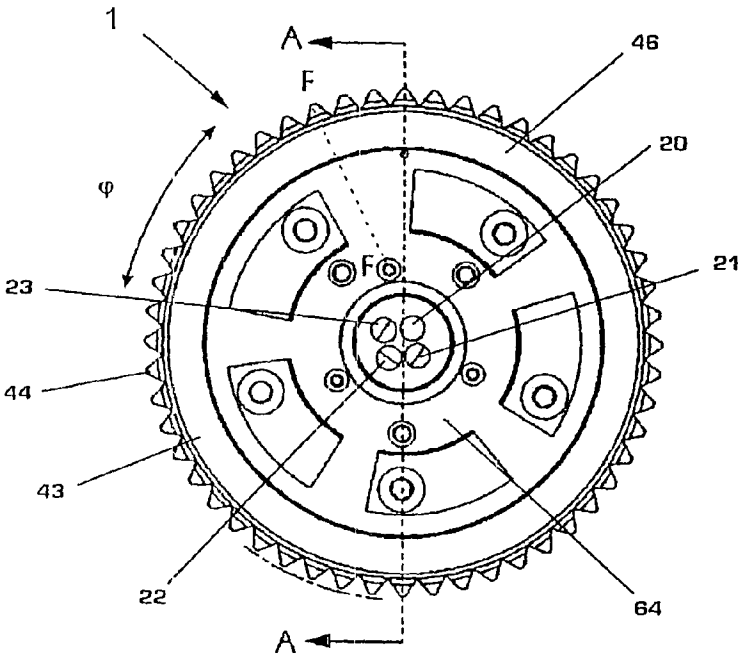
FIG. 1 shows a cam shaft adjuster according to a first exemplary embodiment according to the invention.

FIG. 1 shows an example cam shaft adjuster 1 in accordance with one embodiment of the present invention, which is configured as a rotary vane adjuster. The rotary vane adjuster can rotate within a certain angular range $\phi$ freely from one side to the second side. The rotation is caused by oil from feed line channels 20, 21, 22, 23 by means of which opposite chambers 67, 68 (see FIG. 4) can be acted on. The cam shaft adjuster 1, which is configured as a double cam shaft adjuster, is driven by a single drive wheel 43. In the example shown in FIG. 1, the drive wheel 43 is a chain wheel 44. Chain wheels 44 are distinguished by reduced slippage. The outer casing of the cam shaft adjuster 1 serves as a uniform drive body 46, at the center of which at least two output members 62, 63 (see FIGS. 4 and 6) are arranged axially identically. At the center, a vane crown 64, which is positioned below the signal transmitter wheel (not explicitly drawn out), is twofold, namely mutually adjacent, in the cam shaft adjuster 1.

Figure 2:
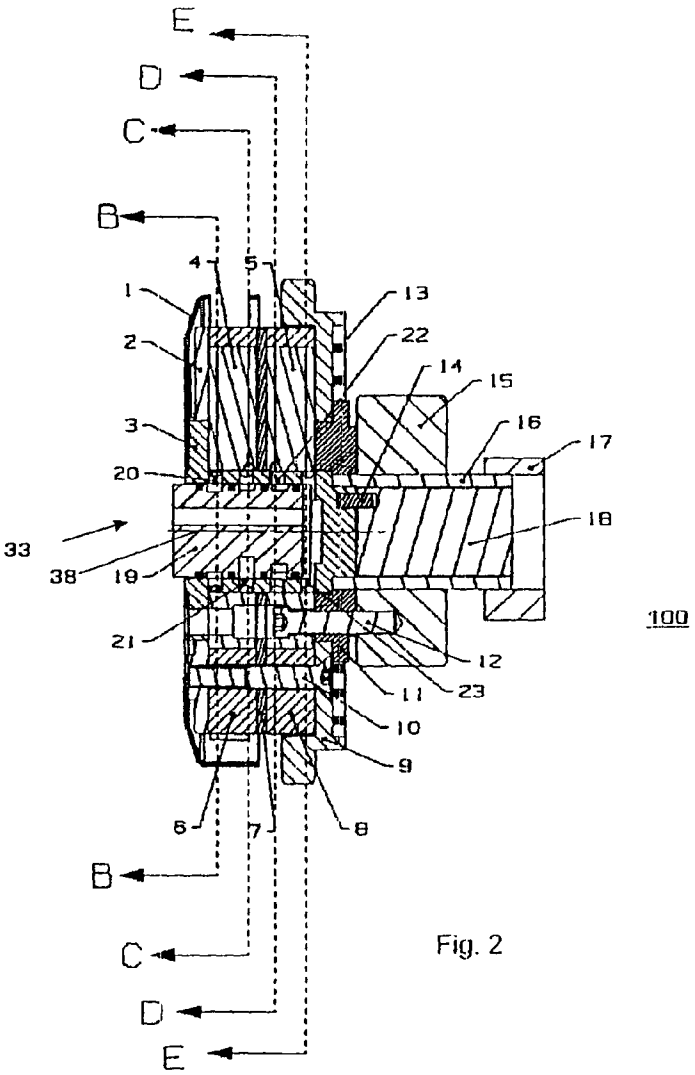
FIG. 2 shows the cam shaft adjuster according to FIG. 1 along the section A-A.

FIG. 2 shows the inner construction of the cam shaft adjuster 1 in a sectional view along the section A-A of FIG. 1. It may be seen that the cam shaft adjuster 1 is a layered adjuster, in the interior of which two rotors 4, 5 are located. The inner rotor 5 is positioned closer to the cam shafts 16, 18 which together form a common cam shaft. The cam shafts 16, 18 pass through the same cam shaft bearing 17 which supports the second, inner central cam shaft 18 via the outer cam shaft 16. The remaining components 4, 5, 7, which are arranged in layers, of the cam shaft adjuster 1 extend between the face plate 2 and the reverse side plate 9. The rotors 4, 5 are separated from each other by a central plate 7. A central plate 7 separates jointly the rotors 4, 5. Central plate 7 and the stators are stationary relative to one another in a rotating manner. The face plate 2 is centered by an axial journal 3 in alignment with the cam shafts 16, 18 to be connected. An oil distributor 19 with numerous channels secures the supply of oil into the chambers of the cam shaft adjuster 1. For this purpose, the oil distributor 19 has at least four feed line channels 20, 21, 22, 23. As may be seen in FIGS. 3-6, the feed line channels extend in at least four chamber feed lines 24, 25, 26, 27. The cam shafts 16, 18 are braced jointly onto the cam shaft adjuster 1 by at least one tensioning pin 14. The cam shafts 16, 18 are surrounded by an axial journal 15. The cam shaft adjuster 1 is attached to the cam shaft via an adapter 11. The individual parts 2, 6, 7, 8, 9 of the cam shaft adjuster 1 can be braced together and screwed in a stationary manner relative to one another via screws 10 such as countersunk head screws 12. Both rotors 4, 5 can rotate relative to the braced parts between stop webs 65, 66 (see FIG. 3). At least one of the two rotors 4, 5, in many cases the rotor 5 which is connected to the inlet cam shaft, is pressed into a constrained position by a spring 13, which can be a spiral spring, if the chambers 67, 68 are free from oil and thus from pressure. The cam shafts 16, 18 form part of the valve drive 100. An inlet point 33 for a hydraulic medium is provided at the face of the cam shaft adjuster 1, thus allowing the hydraulic medium to be brought up to the respective rotor 4, 5 parallel to the cam shaft axis 38.

FIG. 2 indicates four sections B-B, C-C, D-D, E-E which recur in FIGS. 3 to 6. The sections B-B and C-C pass through the first rotor 4 and the sections D-D and E-E pass through the second rotor 5. In FIGS. 3 to 6, oil is supplied via at least four feed line channels 20, 21, 22, 23 extending parallel along the valve drive axis, each channel opening into a chamber feed line crown 24, 25, 26, 27. Both rotors 4, 5 have the same pivoting range. The range is determined from the angular spacing of the webs 65, 66. Each rotor and 4, 5 has at least one first chamber 67 and a second chamber 68. A set 69 of first chambers and a set 70 of second chambers for each partial cam shaft adjuster are formed from multiple occurring chambers of the same type. Oil is thus supplied for all four chamber systems via the cam shaft adjuster center 71. Each rotor 4, 5 (FIG. 2) is an output member 62, 63 (FIG. 4, 6) for a cam shaft 16, 18. The output members are threaded one after another along the cam shaft axis 38. In at least one of the rotors 4, 5, an interlocking pin 34 can be embodied for arresting the rotor 4 with the stator 6 in particular operating states. Thus, both a first and a second rotor 4, 5 are introduced in a drive body 46. The rotor vanes are suspended, pointing outward, from the vane crown 64 which runs centrally.

Figure 7:
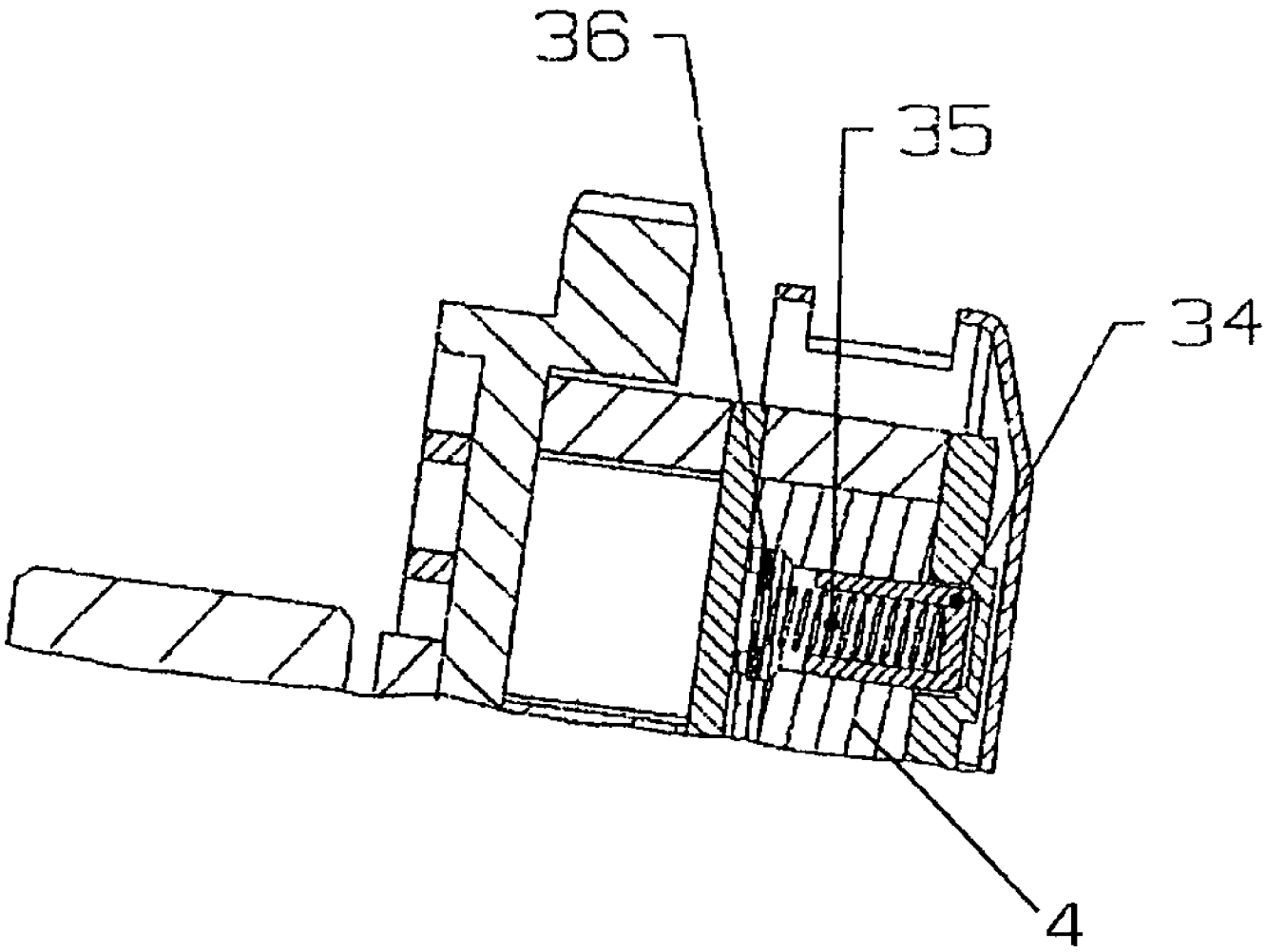
FIG. 7 shows the cam shaft adjuster according to FIG. 1 along a further section around an interlocking pin.

A possible configuration of the interlocking mechanism, consisting inter alia of the following parts: locking pin 34, locking pin spring 35 and spring bearing 36, can be observed in a design configuration in FIG. 7 (section F-F). A plurality of locking pins can also be placed in both rotors 4, 5.

The hydraulic medium, oil, is applied to the face of the cam shaft adjuster 1 according to FIG. 2. The transfer point, which serves as an introduction point 33 for the oil, is located in the oil distributor 19.

Figure 8:
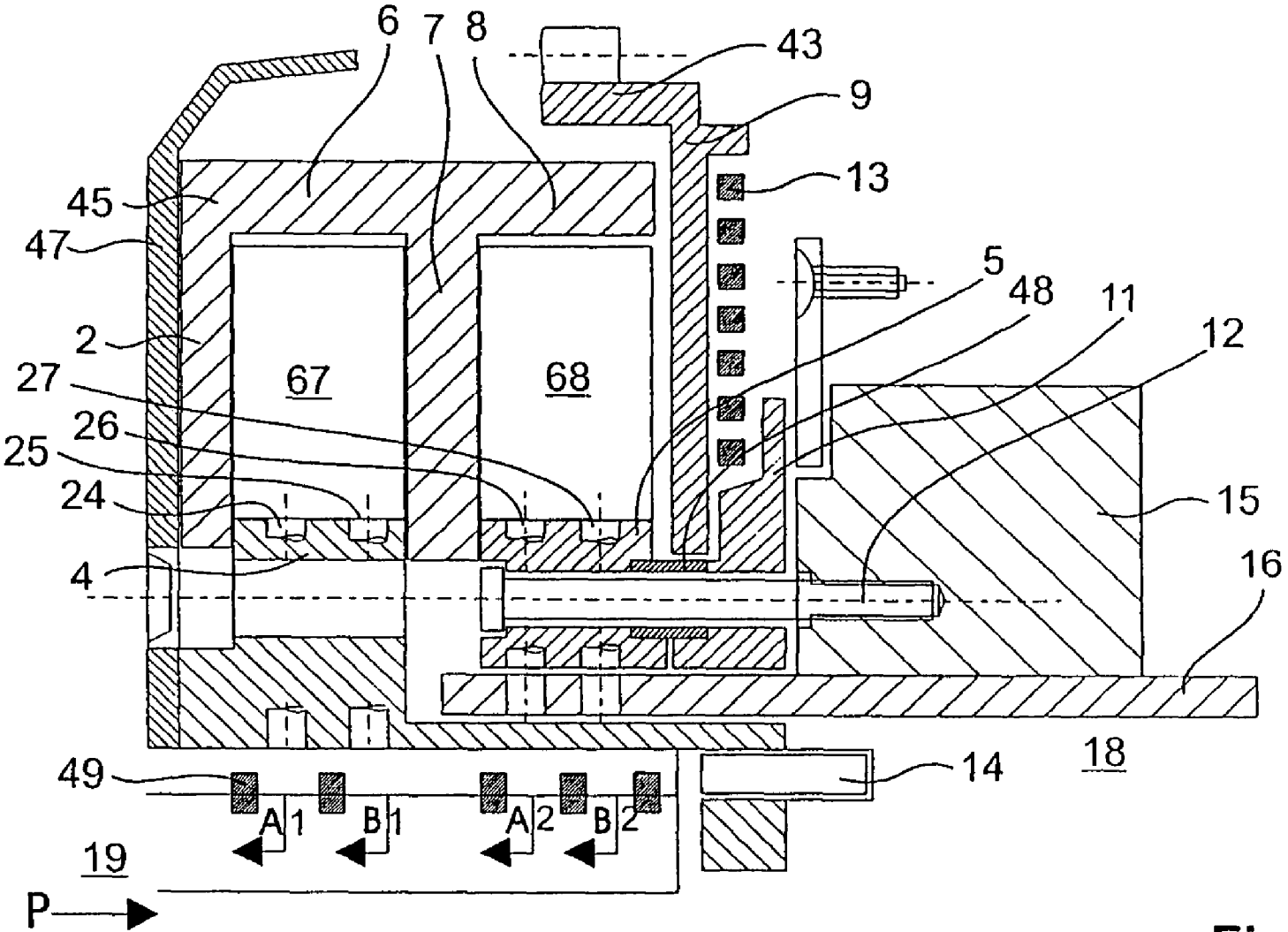
FIG. 8 is a schematic view of a further exemplary embodiment according to the invention.

FIG. 8 is a further view of an exemplary embodiment according to the invention of a cam shaft adjuster 1 as a doubled, swivel motor-type cam shaft adjuster. For the sake of clarity, the individual components, such as the stator housing 45, cam shafts 16, 18 and rotors 4, 5, which can be provided as a cast, embossed or rolled part, are each graphically illustrated set somewhat apart from one another. The two rotors 4, 5 can assume independently of each other any position in their respective pivoting range. The two rotors 4, 5 are uncoupled. They are positioned in the stator housing 45. The stator housing 45 is, as is graphically illustrated in the drawings, a one-piece, continuous body which comprises a plurality of chambers and can be manufactured for example as a cast part. Individual portions of the stator housing 45 can be described as the face plate 2, first stator 6, central plate 7 and second stator 8. The portions 2, 6, 7 and 8 are continuous. In an alternative configuration, the individual regions, such as the first stator 6 and second stator 8, can also be configured so as to be offset from one another and joinable. Thus, two identical parts can also be joined together. Chambers 67 are formed from the free spaces between the first rotor 4 and the first stator 6. Likewise, chambers 68 are formed from the second stator 8 and the second rotor 5. Individual chamber feed lines 24, 25, 26, 27—at least two in number—are drilled into each rotor 4, 5. Along the oil distributor 19, which is embodied so as to have a plurality of members and a plurality of channels, the hydraulic medium flows in at least four hydraulic pressure systems into the respective chamber which is arranged at the end of the channel. The hydraulic medium is under pressure P when it is fed into the chambers 67, 68 for one-sided adjustment. The hydraulic pressure systems are symbolised by A1, B1, A2, B2. Hydraulic isolation is ensured by the seals 49 which are in this case arranged next to one another in a schematically aligned manner. The outer rotor 4 extends at its center under the inner rotor 5 surrounding it up to the cam shaft 18 associated therewith. The inner cam shaft 18 is enclosed by the outer cam shaft 16. According to one configuration, the rear, outer rotor 4 is fastened to the cam shaft 18 (merely indicated) using a tensioning pin 14. For protecting the stator housing 45, a cam shaft adjuster cover 47 can be drawn over the inner part of the cam shaft adjuster 1. The cam shaft adjuster cover 47 opens into the drive wheel 43 which has a surface which is shaped in the opposite manner to a drive belt. The drive wheel 43 is part of the reverse side plate 9. A spring 13, which presses at least one of the two rotors 4, 5 into a preferred position, is inserted in the reverse side plate 9. The space for receiving the spring 13 is located between the reverse side plate 9 and an adapter 11. The adapter 11 ensures secure linking of the rotor 5 to the outer cam shaft 16. A countersunk head screw 12 can be used to screw the rotor 5, which is less bulky than the second rotor 4 which is arranged parallel to it, onto the axial journal 15. For this purpose, a plurality of countersunk head screws 12 are arranged, generally distributed uniformly around the periphery, in a respective continuous bore in a bracing manner between the axial journal 15 and one of the rotors 4, 5. Rotary turns of the screws 12 can be sealed by sealing sleeves 48. The cam shaft adjuster 1 is illustrated, only in its upper, cut half, predominantly schematically in FIG. 8.

Figure 9:
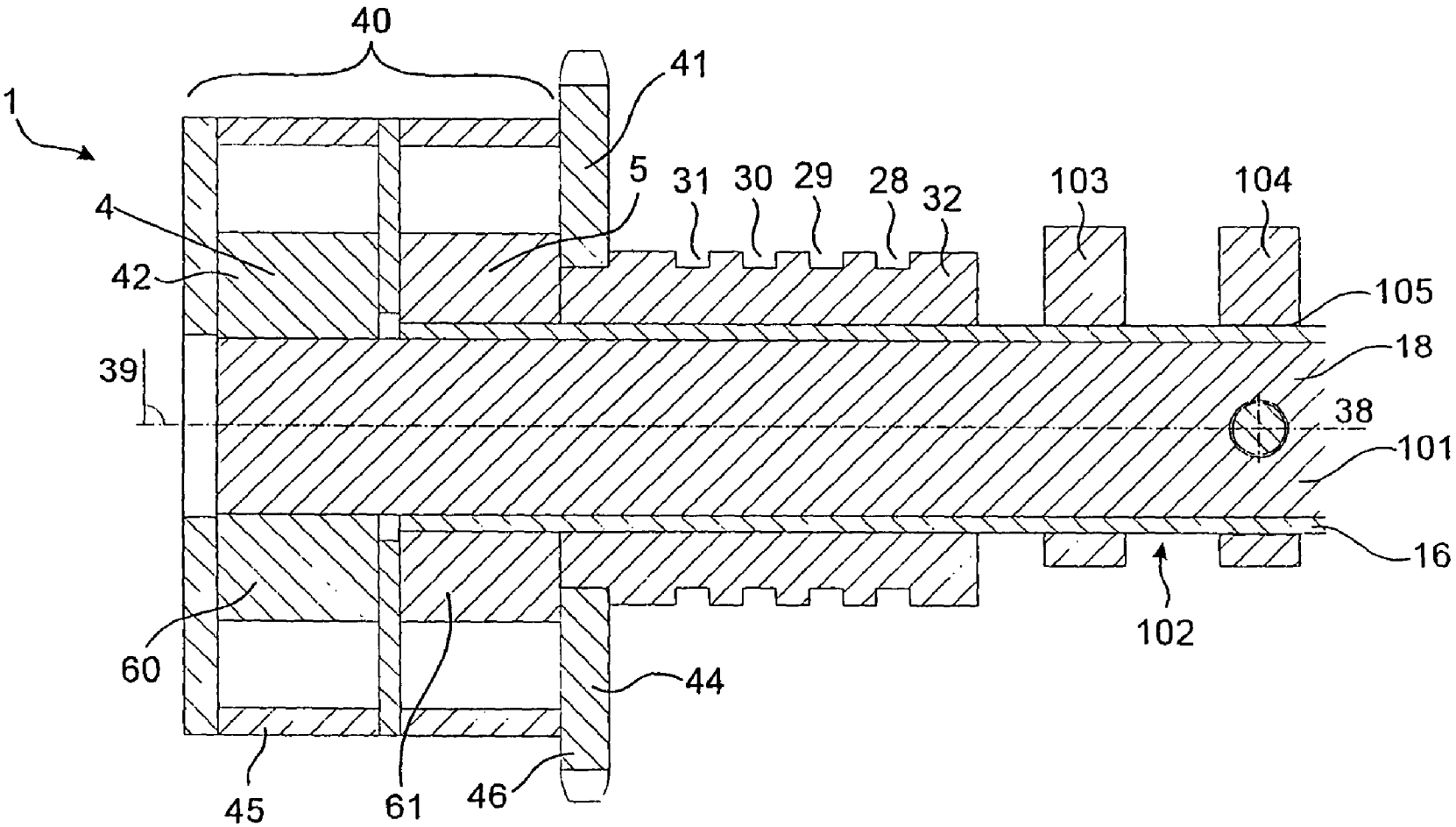
FIG. 9 is a schematic view of a further exemplary embodiment according to the invention.

A further configuration according to the invention of a cam shaft adjuster 1 with two cam shafts 16, 18 may be seen in FIG. 9. FIG. 9 illustrates schematically the linking of the (double) cam shaft adjuster 1, which is arranged in an axial arrangement, to the (double) cam shaft 101 comprising at least two different sets of cams 103, 104. The double cam shaft 101 comprises the two cam shafts 16, 18 which are embodied coaxially. One set of cams 103 is linked to the outer cam shaft 16, while the second set of cams 104 is in an immovable relative relationship to the inner cam shaft 18. As a result of mutual rotation of one cam shaft 16 relative to the second cam shaft 18, the gas exchange valve control shaft 102 can carry out different opening and closing times of the gas exchange valves (not shown). The cam shaft adjuster 1 has a side 41 close to the cam shaft and a side 42 remote from the cam shaft. The drive body 46, in particular in the form of a chain wheel 44, is placed on the side 41 close to the cam shaft. The cam shaft adjuster 1 has an axial arrangement 40 of the individual layers 60, 61. In order to introduce the hydraulic control means for the phase adjustment of the individual layers 60, 61 of the cam shaft adjuster 1, a connection crown 32 surrounds the doubled cam shaft 101 in one of its end regions. The connection crown 32 has a plurality of ports 28, 29, 30, 31—at least four ports 28, 29, 30, 31 which can be activated independently of one another-which can be used as oil transfer points. The first cam shaft 16 has at least one recess 105 through which one of the cams 104 reaches the outside of the doubled cam shaft 101. The rotational movement of each layer 60, 61 is transmitted to a cam shaft 16, 18 directly and in a non-translatory manner, thus forming the same pivoting angle on the cams 103, 104. For this purpose, the components are lined up along the axis 38 of the cam shaft 101. The rotors 4, 5 extend normally, i.e. in a normal line 39, to the cam shaft axis 38.

Figure 10:
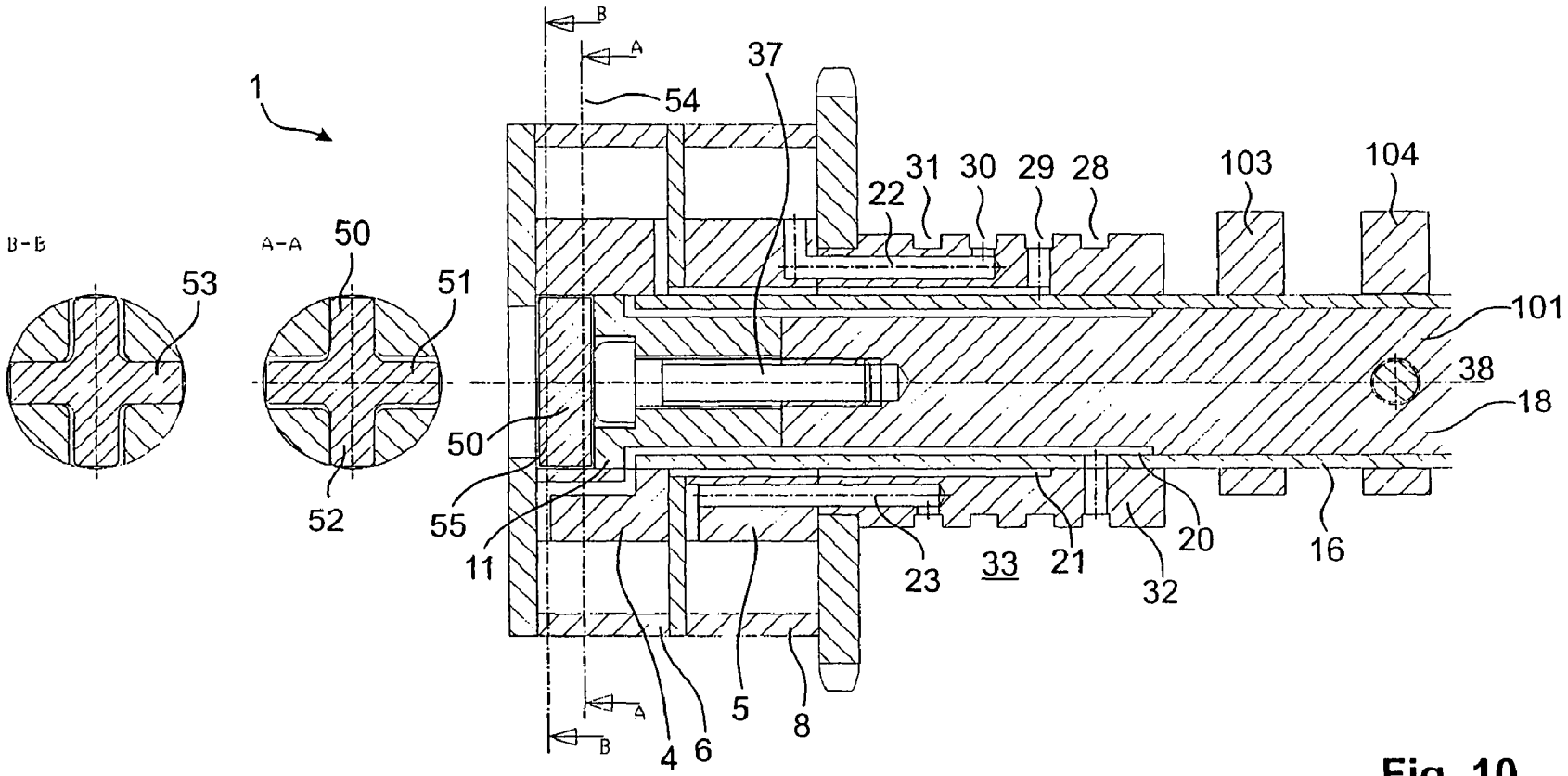
FIG. 10 is a schematic view of a further exemplary embodiment according to the invention.
Figure 11:
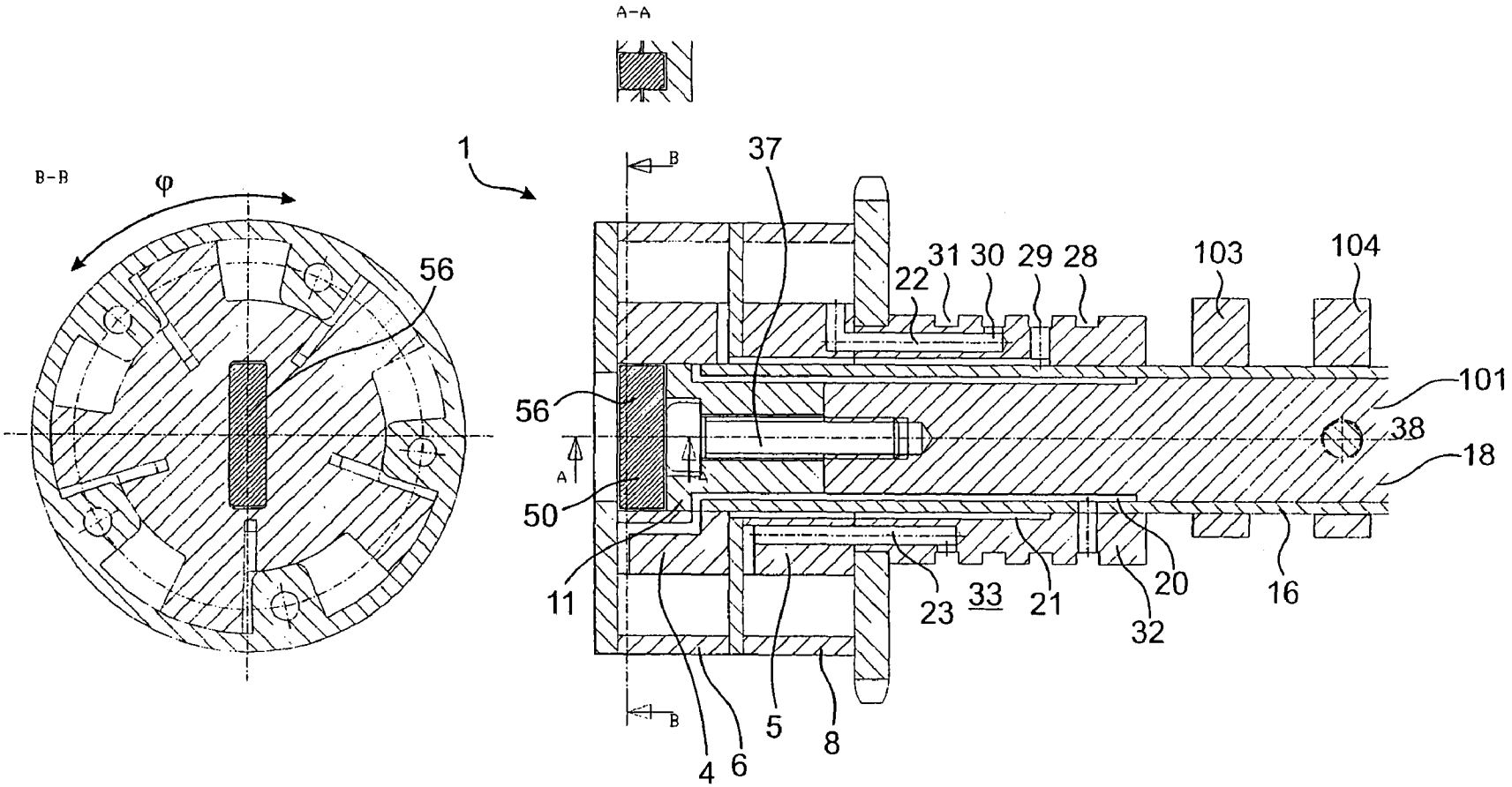
FIG. 11 is a schematic view of a further exemplary embodiment according to the invention.

FIGS. 10 and 11 schematically show a similar configuration of a valve drive with sets of cams, the phase positions of which are to be altered, of at least two different types of cams 103, 104 on a double cam shaft 101 composed of two cam shafts 16, 18. The exemplary embodiments from FIG. 10 and FIG. 11 differ inter alia in the form of the compensating element 50, 56. In FIGS. 10 and 11, the forwarding from the ports 28, 29, 30, 31 in the connection crown 32 via feed line channels 20, 21, 22, 23 is also illustrated in greater detail than in any exemplary embodiments described hereinbefore. The ports 28, 29, 30, 31 can be configured as annular channels, in particular in symmetrical embodiment. A feed line channel 20, 21, 22, 23, which, configured as a bore, can be guided in the connection crown 32, in the cam shaft 101 or between the individual cam shafts 16, 18, connects to any point of the annular channel. For example, the feed line channel 23 for the rotor 5 is, as the supply line of the chambers of the first type, guided on the rotor 5 or between rotor 5 and its associated stator 8 in certain portions in the connection crown 32 and in the rotor 5. The feed line channel 20 is configured as a terminally arranged recess or lathed-in part from the inner cam shaft 18 up to the rotor 4. The rotor 4 forms with the stator 6 individual chambers which are in their variable volume independent of the second rotor 5. Thus, the hydraulic medium can reach the chambers from the introduction point 33 via various channel systems 20, 21, 22, 23. A particular adapter 11, through which a fastening screw can be guided as the central cam shaft fastening screw 37, joins one of the rotors 4, 5, namely the rotor 4, to the cam shaft 18 connected thereto. A compensating element 50 is arranged at the center of the rotor 4. The compensating element 50 can be mounted upstream of the screw 37. The compensating element 50 lies in the axial extension of the doubled cam shaft 101, the two individual cam shafts 16, 18 of which extend on the cam shaft axis 38. In one configuration, the compensating element 50 is a cross joint 51 in two different planes 54, 55 which are indicated by the sections A-A and B-B. In each plane 54, 55 there are individual sliding members 52, 53 which can compensate with play for tilting between a cam shaft 16, 18, 101 and at least one rotor 4, 5. Alternatively, it is also expedient to use one or more rotary journals. It is particularly advantageous to use two sets of two rotary joints. Deflections from the cam shaft axis 38 of the rotors 4, 5 are intercepted by the compensating element 50.

The compensating element 56 according to FIG. 11 is a flat, elongate article which is designed as a fitting key for a groove, with two spherical surfaces which are joined together. In profile, the compensating element 56 is comparable to a horizontal figure of eight. The orientation and arrangement of the compensating element 56 relative to the cam shaft axis 38 allows angling in the axial direction to be compensated for.

As a result of compensating elements 50 such as fitting key 56 or a cross joint 51, the angle of rotation $\phi$ for each rotor 4, 5 and the cam shaft 16, 18 connected thereto is preserved irrespective of the rotational behavior of the other rotor 5, 4 despite the gas exchange valves control shaft 102 which is extended in an elongate manner on the cam shaft axis 38.

The inner cam shaft 18 may be configured in a solid manner. A cast cam shaft can for example be used. The outer cam shaft 16, surrounding the inner cam shaft 18, can be configured as a hollow body cam shaft. The hollow body cam shaft, which is also referred to as a hollow cam shaft, can be a constructed cam shaft.

An adapter 11 can be provided between the respective cam shaft 16, 18 and the respective rotor 5, 4. As a result of the interposition of an adapter 11, the rotor 5 can be constructed in an identical manner to rotor 4. This allows the number of identical parts to be increased. Although in the relatively schematic contrast of FIGS. 10 and 11, the two differently embodied compensating elements are shown in the relative view to be almost the same size, calculations and engineering estimates have shown that the compensating element 56 of FIG. 11 can be configured so as to be much flatter and more compact than the compensating element 50 of FIG. 10, because the compensating element 56 offers the necessary degrees of freedom only in a single plane.

Any person skilled in the art will understand that, in addition to the illustrated exemplary embodiments, the teaching according to the invention can also be carried out in a combination of the various exemplary embodiments. Thus, it is possible to provide, in the case of an oil supply conveyed via cam shaft bearings, a distributing journal with stepped, fanned-out ends for supplying oil to the chambers of the two cam shaft adjusters. Equally, it is possible also to arrange more than two, i.e. three or four, rotors, which do not restrict one another in the angular pivoting range, parallel to one another on the same axis.

It should now be appreciated that the present invention provides advantageous methods and apparatus a cam shaft adjuster for controlling a double cam shaft.

Although the invention has been described in connection with various illustrated embodiments, numerous modifications and adaptations may be made thereto without departing from the spirit and scope of the invention as set forth in the claims.

LIST OF REFERENCE NUMERALS

| Reference numeral | Meaning | Figure used |
|---|---|---|
| 1 | Cam shaft adjuster | FIG. 1, FIG. 2, FIG. 8, FIG. 9 |
| 2 | Face plate | FIG. 2, FIG. 8 |
| 3 | Axial journal | FIG. 2 |
| 4 | Outer rotor or first rotor or end rotor | FIG. 2, FIG. 7, FIG. 8, FIG. 9, FIG. 10, FIG. 11 |
| 5 | Inner rotor or second rotor or reverse side rotor | FIG. 2, FIG. 8, FIG. 9, FIG. 10, FIG. 11 |
| 6 | First stator or end stator | FIG. 2, FIG. 8, FIG. 10, FIG. 11 |
| 7 | Central plate, in particular as a common separating plate | FIG. 2, FIG. 8 |
| 8 | Second stator or reverse side stator | FIG. 2, FIG. 8, FIG. 10, FIG. 11 |
| 9 | Reverse side plate | FIG. 2, FIG. 8 |
| 10 | Screw | FIG. 2 |
| 11 | Adapter, in particular backward adapter | FIG. 2, FIG. 8, FIG. 10, FIG. 11 |
| 12 | Countersunk head screw | FIG. 2, FIG. 8 |
| 13 | Spring, in particular in the form of a spiral spring | FIG. 2, FIG. 8 |
| 14 | Tensioning pin | FIG. 2, FIG. 8 |
| 15 | Axial journal | FIG. 2, FIG. 8 |
| 16 | First cam shaft | FIG. 2, FIG. 8, FIG. 9, FIG. 10, FIG. 11 |
| 17 | Cam shaft bearing | FIG. 2 |
| 18 | Second cam shaft as the central cam shaft | FIG. 2, FIG. 8, FIG. 9, FIG. 10, FIG. 11 |
| 19 | Oil distributor | FIG. 2, FIG. 8 |
| 20 | First feed line channel | FIG. 1, FIG. 2, FIG. 3, FIG. 10, FIG. 11 |
| 21 | Second feed line channel | FIG. 1, FIG. 2, FIG. 4, FIG. 10, FIG. 11 |
| 22 | Third feed line channel | FIG. 1, FIG. 2, FIG. 5, FIG. 10, FIG. 11 |
| 23 | Fourth feed line channel | FIG. 1, FIG. 2, FIG. 6, FIG. 10, FIG. 11 |
| 24 | First chamber feed line | FIG. 3, FIG. 8 |
| 25 | Second chamber feed line | FIG. 4, FIG. 8 |
| 26 | Third chamber feed line | FIG. 5, FIG. 8 |
| 27 | Fourth chamber feed line | FIG. 6, FIG. 8 |
| 28 | First port | FIG. 9 |
| 29 | Second port | FIG. 9 |
| 30 | Third port | FIG. 9 |
| 31 | Fourth port | FIG. 9 |
| 32 | Connection crown | FIG. 9, FIG. 10, FIG. 11 |
| 33 | Introduction point for the hydraulic medium | FIG. 2 |
| 34 | Locking pin | FIG. 4, FIG. 7 |
| 35 | Locking pin spring | FIG. 7 |
| 36 | Spring bearing | FIG. 7 |
| 37 | Fastening screw, in particular central screw | FIG. 10, FIG. 11 |
| 38 | Cam shaft axis | FIG. 2, FIG. 9, FIG. 10, FIG. 11 |
| 39 | Normal line relative to the cam shaft axis | FIG. 9 |
| 40 | Axial arrangement, in particular relative to the cam shaft | FIG. 8, FIG. 9 |
| 41 | Side close to the cam shaft | FIG. 9 |
| 42 | Side remote from the cam shaft | FIG. 9 |
| 43 | Drive wheel | FIG. 1, FIG. 8 |
| 44 | Chain wheel | FIG. 1, FIG. 9 |
| 45 | Stator housing | FIG. 8, FIG. 9 |
| 46 | Drive body | FIG. 1, FIG. 4, FIG. 8, FIG. 9 |
| 47 | Cam shaft adjuster cover | FIG. 8 |
| 48 | Sealing sleeve | FIG. 8 |
| 49 | Seal | FIG. 8 |
| 50 | Compensating element | FIG. 10, FIG. 11 |
| 51 | Cross joint | FIG. 10 |
| 52 | First sliding member | FIG. 10 |
| 53 | Second sliding member | FIG. 10 |
| 54 | First plane of the compensating element | FIG. 10 |
| 55 | Second plane of the compensating element | FIG. 10 |
| 56 | Fitting key | FIG. 11 |
| 60 | First layer of the cam shaft adjuster | FIG. 9 |
| 61 | Second layer of the cam shaft adjuster | FIG. 9 |
| 62 | First output member | FIG. 4 |
| 63 | Second output member | FIG. 6 |
| 64 | Vane crown (partly covered by cover and signal transmitter wheel) | FIG. 1, FIG. 3 |
| 65 | First web | FIG. 3 |
| 66 | Second web | FIG. 3 |
| 67 | First chamber | FIG. 4, FIG. 8 |
| 68 | Second chamber | FIG. 4, FIG. 8 |
| 69 | First set of chambers | FIG. 3 |
| 70 | Second set of chambers | FIG. 3 |
| 71 | Cam shaft adjuster center | FIG. 5 |
| 100 | Valve drive | FIG. 2 |
| 101 | Cam shaft, in particular doubled cam shaft | FIG. 9, FIG. 10, FIG. 11 |
| 102 | Gas exchange valve control shaft | FIG. 9 |
| 103 | Cams of the first type | FIG. 9, FIG. 10, FIG. 11 |
| 104 | Cams of the second type | FIG. 9, FIG. 10, FIG. 11 |
| 105 | Recess in the first cam shaft, in particular for passing through a cam | FIG. 9 |
| A-A | Section | FIG. 1 |
| B-B | Section | FIG. 2, FIG. 3 |
| C-C | Section | FIG. 2, FIG. 4 |
| D-D | Section | FIG. 2, FIG. 5 |
| E-E | Section | FIG. 2, FIG. 6 |
| F-F | Section | FIG. 7 |
| A1 | Oil channel system for the first set of chambers | FIG. 8 |
| B1 | Oil channel system for the second set of chambers | FIG. 8 |
| A2 | Oil channel system for the third set of chambers | FIG. 8 |
| B2 | Oil channel system for the fourth set of chambers | FIG. 8 |
| P | Pressurised hydraulic medium | FIG. 8 |
| $\phi$ | Angle of rotation | FIG. 1, FIG. 11 |

What is claimed is:

1. Cam shaft adjuster for controlling a double cam shaft with a first and a second cam shaft, comprising:
a first layer;
a second layer;
a first rotor-type output body with a first rotary vane body having a center;
a second rotor-type output body with a second rotary vane body having a center; and
a compensating element;
wherein:
the cam shaft adjuster has a layered construction;
said layered construction is made by the first rotor-type output body and by the second rotor-type output body which are arranged parallel to each other with their rotary vane body parts,
each output body being designed for reception of at least one cam shaft of the double cam shaft leading laterally out of a center of the cam shaft adjuster,
the compensating element is provided for orienting at least one of the first and second rotor-type output body relative to the double cam shaft;
the compensating element is a movable member;
said movable member creates at least one degree of freedom;
the at least one output body is adapted to be connected to an inner part of said double cam shaft;
said movable member allows deflection of the at least one output body relative to the inner part of the cam shaft; and
said deflection differs from a right angle formed between a plane of extension of the at least one output body and a longitudinal axis of the inner cam shaft.

2. Cam shaft adjuster according to claim 1, wherein:
the compensating element is a cross joint which has a first and a second sliding member,
one of said first and second sliding members can be brought into abutment with the cam shaft, while said other of said first and second sliding members can be brought into abutment with the at least one output body.

3. Cam shaft adjuster according to claim 1, wherein the compensating element comprises a fitting key for a corresponding groove.

4. Cam shaft adjuster according to claim 3, wherein the fitting key is embodied in a dually spherical manner and allows lateral tilting out of the at least one output body in a cam shaft axial direction.

5. Cam shaft adjuster for controlling a double cam shaft with a first and a second cam shaft, comprising:
a first layer;
a second layer;
a first rotor-type output body with a first rotary vane body having a center;
a second rotor-type output body with a second rotary vane body having a center; and
a compensating element;
wherein:
the cam shaft adjuster has a layered construction;
said layered construction is made by the first rotor-type output body and by the second rotor-type output body which are arranged parallel to each other with their rotary vane body parts,
each output body being designed for reception of at least one cam shaft of the double cam shaft leading laterally out of a center of the cam shaft adjuster,
the compensating element is provided for orienting at least one of the first and second rotor-type output body relative to the double cam shaft,
the cam shaft adjuster has a single compensating element which is an axial compensating element; and
the cam shaft adjuster consists of two parallel individual adjusters which, uncoupled from each other, stand at an angle of rotation delimited by two respective webs of a single drive body.

6. Cam shaft adjuster according to claim 5, wherein:
the compensating element is located at a side of the cam shaft adjuster which is remote from the cam shaft, and
the drive body is a continuous drive body.

7. Variable valve drive of an internal combustion engine, comprising:
a gas exchange valve control shaft,
said gas exchange valve control shaft has two cam shafts are arranged concentrically and which are rotationally adjustable relative to each other and have at least two sets of cams, one set of the cams being linked to each cam shaft,
said cam shafts allow said at least two sets of cams to be angularly rotated relative to one another, and
a cam shaft adjuster, said cam shaft adjuster comprising:
a drive body,
at least one output body, and
at least one compensating element,
wherein:
said cam shaft adjuster allows, in accordance with a rotary vane principle, relative rotation between said drive body and said at least one output body, and
said compensating element is arranged toward a side of the cam shaft adjuster that is remote from the cam shaft for axially orienting and joining the cam shaft adjuster relative to the gas exchange valve control shaft issuing laterally therefrom;
the compensating element is a movable member;
said movable member creates at least one degree of freedom;
said at least one output body is adapted to be connected to an inner part of said double cam shaft;
said movable member allows deflection of the least one output body relative to the inner part of said double cam shaft; and
said deflection differs from a right angle formed between a plane of extension of the at least one output body and a longitudinal axis of the inner cam shaft.

8. Variable valve drive according to claim 7, wherein:
the cam shaft adjuster comprises:
a first layer,
a second layer,
said at least one output body is at least one of a first or a second rotor-type output body,
said first rotor-type output body has a first rotary vane body having a center,
said second rotor-type output body has a second rotary vane body having a center,
wherein:
the cam shaft adjuster has a layered construction,
said layered construction comprising a first layer and a second layer, made by the first rotor-type output body and by the second rotor-type output body which are arranged parallel to each other with their rotary vane body parts.

9. Variable valve drive according to claim 8, wherein the compensating element is a joint.

10. Variable valve drive according to claim 7, wherein:
the cam shaft adjuster has at least two rotary vane adjusters; and each rotary vane adjuster is configured in a rotor-type manner as part of a hydraulic swivel motor.

11. Variable valve drive according to claim 10, wherein each rotary vane adjuster is angularly adjustable as a result of hydraulic pressure in two sets of opposing hydraulic chambers and is a respective output body of a cam shaft.

12. Variable valve drive according to claim 11, wherein each output body comprises a vane crown which is connected to a rotor core and can be moved back and forth between web stops of a surrounding stator housing.

13. Variable valve drive according to claim 7, wherein the gas exchange control shaft is a coaxial dual cam shaft in which a first cam shaft is configured as a hollow body in such a way that a second cam shaft runs in the first cam shaft and the first cam shaft has at least one recess through which a cam of the second cam shaft points onto the outside of the dual cam shaft.

14. Variable valve drive according claim 7, wherein the cam shaft adjuster has a single drive wheel which is arranged on a side close to the cam shaft in such a way that a rotatable connection crown runs in synchronisation with the drive wheel for taking over and forwarding the hydraulic fluid to each chamber of a first and a second rotary vane adjuster.

15. Variable valve drive, according to claim 14, wherein the drive wheel is a chain wheel drivable by a crank shaft.

16. Variable valve drive according to claim 14, wherein the connection crown has at least four hydraulic ports in order to forward from a stationary bearing ring individually adjustable hydraulic fluids into hydraulic chambers of each rotary wing adjuster.

17. Variable valve drive according to claim 16, wherein the bearing ring is configured as part of the cylinder head of an internal combustion engine.

18. Variable valve drive according to claim 7, wherein two feed line channels, which are arranged closer to a cam shaft axis, lead from a connection crown into the rotary vane adjuster, which is arranged further away from introduction points of the connection crown, and two feed line channels, which are arranged further away from the cam shaft axis, lead into the rotary vane adjuster which is close to the connection crown.

19. Variable valve drive according to claim 7, wherein the output body, which is remote from the gas exchange valve control shaft, is arranged for adjusting an inner cam shaft, while the output body, which is arranged closer toward the gas exchange valve control shaft, is designed for adjusting an outer cam shaft surrounding the inner cam shaft.

20. Variable valve drive according to claim 19, wherein the remote output body is screwed at a face onto the inner cam shaft and the output body facing the cam shaft is shrunk onto the outer cam shaft.

21. Variable valve drive of an internal combustion engine, comprising:

a gas exchange valve control shaft, said gas exchange valve control shaft has two cam shafts are arranged concentrically and which are rotationally adjustable relative to each other and have at least two sets of cams, one set of the cams being linked to each cam shaft, said cam shafts allow said at least two sets of cams to be angularly rotated relative to one another, and a cam shaft adjuster, said cam shaft adjuster comprising:

a drive body, at least one output body, and at least one compensating element, wherein:

said cam shaft adjuster allows, in accordance with a rotary vane principle, relative rotation between said drive body and said at least one output body, said compensating element is arranged toward a side of the cam shaft adjuster that is remote from the cam shaft for axially orienting and joining the cam shaft adjuster relative to the gas exchange valve control shaft issuing laterally therefrom, the cam shaft adjuster has a single drive wheel which is arranged on a side close to the cam shaft in such a way that a rotatable connection crown runs in synchronisation with the drive wheel for taking over and forwarding the hydraulic fluid to each chamber of a first and a second rotary vane adjuster, and at least one spring is fastened to the drive wheel, which spring is supported at one side on the drive wheel in order to press at least one of the two rotary vane adjusters into a constrained position.

22. Variable valve drive according to claim 21, wherein said spring is a spiral spring.

* * * * *